US006766602B2

(12) United States Patent
Cox et al.

(10) Patent No.: US 6,766,602 B2
(45) Date of Patent: Jul. 27, 2004

(54) CORNER TOOTH ADAPTER ARRANGEMENT FOR AN EXCAVATING IMPLEMENT

(75) Inventors: Matthew K. Cox, Peoria, IL (US); Brian B. Umbach, Peoria, IL (US); Samuel L. McClallen, Plano, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 10/215,398

(22) Filed: Aug. 8, 2002

(65) Prior Publication Data

US 2004/0025381 A1 Feb. 12, 2004

(51) Int. Cl.[7] ..... E02F 9/28

(52) U.S. Cl. ..... 37/448; 37/452; 172/713; 172/772.5

(58) Field of Search ..... 37/448, 446, 452, 37/455; 172/772, 772.5, 713, 719, 753, 681

(56) References Cited

U.S. PATENT DOCUMENTS

| | | | | |
|---|---|---|---|---|
| 3,736,675 A | | 6/1973 | Shankwitz et al. | |
| 3,762,079 A | * | 10/1973 | Lukavich et al. | |
| 3,812,608 A | | 5/1974 | Ratkowski | |
| 4,007,550 A | | 2/1977 | Stepe | |
| 4,047,312 A | | 9/1977 | Stepe | |
| 4,055,223 A | * | 10/1977 | Casey et al. | 172/777 |
| 4,071,967 A | | 2/1978 | Klett | |
| T973,002 I4 | | 8/1978 | Klerr | |
| 4,182,057 A | * | 1/1980 | Klett et al. | |
| 4,204,349 A | | 5/1980 | Tallis | |
| 4,577,423 A | * | 3/1986 | Hahn | |
| 4,601,119 A | | 7/1986 | Klett | |
| 4,776,113 A | * | 10/1988 | Bedford et al. | |
| 5,335,615 A | | 8/1994 | Bjorkman | |
| 5,353,531 A | | 10/1994 | Doucette | |
| 5,992,062 A | | 11/1999 | Evans et al. | |
| 2003/0037467 A1 | * | 2/2003 | Bierwith | 37/455 |

FOREIGN PATENT DOCUMENTS

JP 59-106629 A * 6/1984

* cited by examiner

*Primary Examiner*—Christopher J. Novosad
(74) *Attorney, Agent, or Firm*—Todd A. Benni

(57) ABSTRACT

The present invention is directed to a corner adapter for attaching a ground engaging tooth to an implement bucket. The corner adapter includes a nose portion, a bottom strap and a top strap. The nose portion and the bottom strap are aligned along substantially common longitudinal axes, the top strap is aligned along a longitudinal axis that defines an offset angle. A cutout portion and gusset are provided in the top strap to permit the corner adapter to engage the side wall.

13 Claims, 4 Drawing Sheets

CORNER TOOTH ADAPTER ARRANGEMENT FOR AN EXCAVATING IMPLEMENT

TECHNICAL FIELD

The present invention relates generally to a bucket for an excavating machine and more particularly to a corner adapter for mounting a ground engaging tooth to an excavating bucket.

BACKGROUND

Buckets for excavating machines such as hydraulic excavators, backhoes, wheel loaders and the like include a plurality of ground engaging teeth disposed on a cutting edge. The teeth are evenly spaced between a pair of bucket side walls. Each tooth is removably attached to an adapter, that is in-turn welded to the cutting edge of the bucket. While most teeth and adapters extend perpendicularly outward from the leading edge, some tips positioned at corners of the bucket are arranged to extend outward past the side wall. Having the teeth angled outwardly on the corners loosens material beyond the bucket sides, thus reducing drag.

An example of a tip and adapter that extends at an outward angle past the side wall is in shown in U.S. Pat. No. 5,992,062 to Evans et al. As shown the adapter includes a top strap, a bottom strap and a nose portion. A longitudinal axis is defined on each of the top and bottom straps, the nose portion defines another longitudinal axis. Each of the longitudinal axes are parallel to one and other. The geometry of these corner adapters includes multiple compound angles where the nose portion connects with the top and bottom straps. These compound angles increases cost of tooling and expense associated with manufacturing the adapter. Three different patterns are required to make these castings, a right corner, a left corner and center patterns.

Additionally, the corner adapters shown in Evans et al are positioned into a notch formed into the side wall of the bucket above the base edge. A first weld is provided around the top and bottom straps, fixing the adapter to the base edge, a second weld is provided between the top strap and the notch in the wall. This attachment method complicates the replacement of a worn corner adapter because the welds must be removed using a cutting torch. Removing the second weld often results in excess damage to the side wall. Also the interface between the base edge and side walls undergoes extremely high stress during digging operations.

An additional problem related to corner adapters, is the positioning of the welds used to attach the adapter to the bucket. The welds are typically positioned at unfavorable locations having high stress concentrations, such as where the thickness of the strap is reduced. This increases the potential for failure of the adapter.

The present invention is directed to overcoming one or more of the above mentioned problems.

SUMMARY OF THE INVENTION

The present invention provides a corner adapter for use with an implement bucket. The corner adapter is adapted to receive a ground engaging tooth and includes a nose portion having a back end, top surface, a bottom surface and a first longitudinal centerline. A top and bottom strap extend from said back end of the nose portion. The bottom strap includes a top surface, a bottom surface and a pair of side surfaces extending between the top and bottom surfaces. A second longitudinal centerline is defined between the top and bottom surfaces of the bottom strap. The top strap includes a top surface, a bottom surface and an inner side surface and an outer side surface extending between the top and bottom surfaces. A third longitudinal centerline is defined between the inner side surface and the outer side surface, wherein an angle is defined between the first centerline and the third centerline.

DETAILED DESCRIPTION

Figure 1:
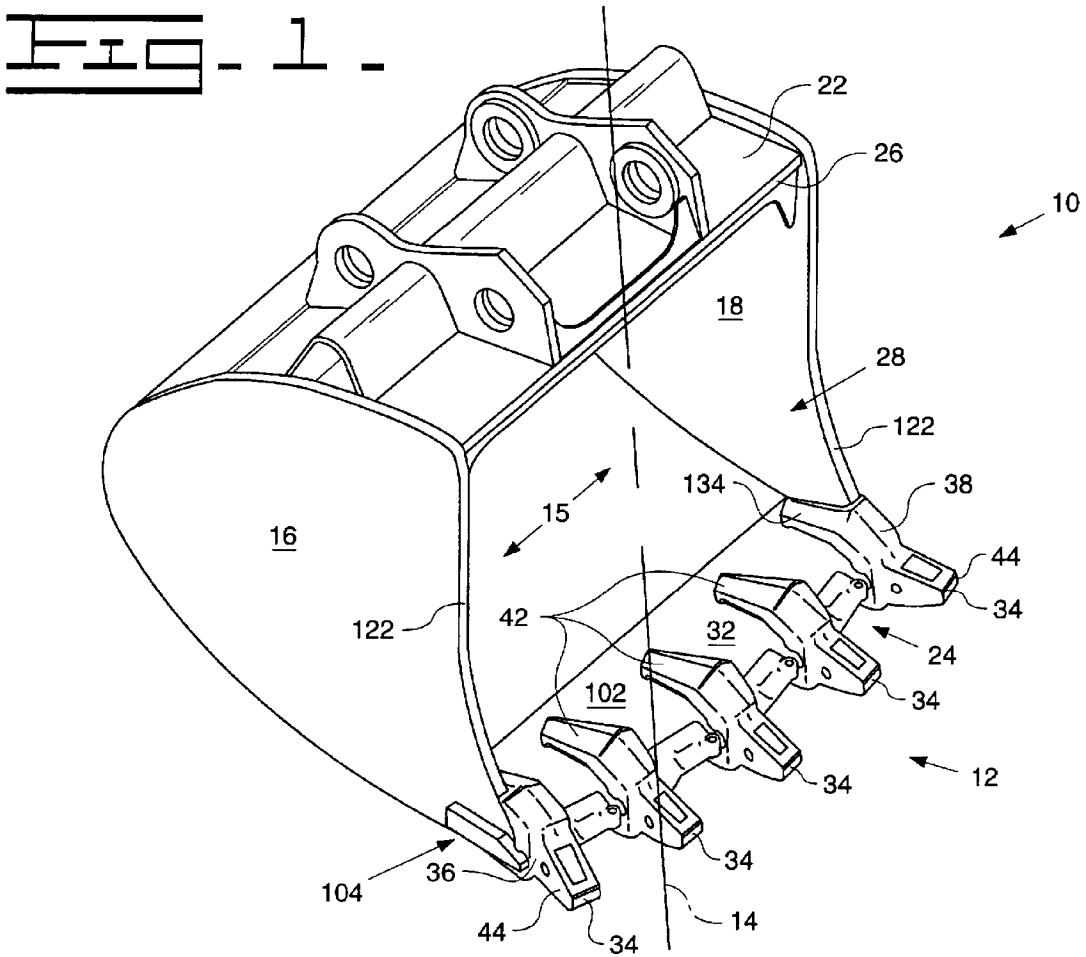
FIG. 1 is a perspective view of an implement bucket employing corner adapters of the present invention installed thereon.

Referring to FIG. 1, an implement bucket 10 similar to those used on hydraulic excavators or backhoes is illustrated. The implement bucket 10 as viewed from the front 12, is defined about a vertical centerline 14 and has a pair of side walls 15, including a left side wall 16 and a right side wall 18. Each of the pair of side walls 15 further defines a leading edge 122. A wrapper 22 is disposed between the right and left side walls 16,18. The wrapper 22 defines a lower leading edge 24 and an upper leading edge 26 and an opening 28. A base edge 32 is disposed on the lower leading edge 24 of the bucket 10. The base edge 32 acts to protect and strengthen the leading edge 24 of the bucket 10.

A plurality of adapters 34 are spaced along and attached to the base edge 32. The plurality of adapters 34 include a left corner adapter 36, a right corner adapter 38 and one or more straight adapters 42, spaced between the left 36 and right corner adapter 38. The adapters 34 are typically attached to the bucket by welding. Each adapter 34 is configured to fixedly receive a ground engaging tooth (not shown).

The left and right corner adapters 36, 38 are substantially mirrored images of one and other. The left corner adapter 36 is configured in a manner to cause the left ground engaging tooth to extend away from the vertical centerline 14 of the bucket 10 at an angle, thus causing the tooth to extend outward past the left side wall 16. In turn, the right corner adapter 38 extends outward past the right side wall 18.

Figure 2:
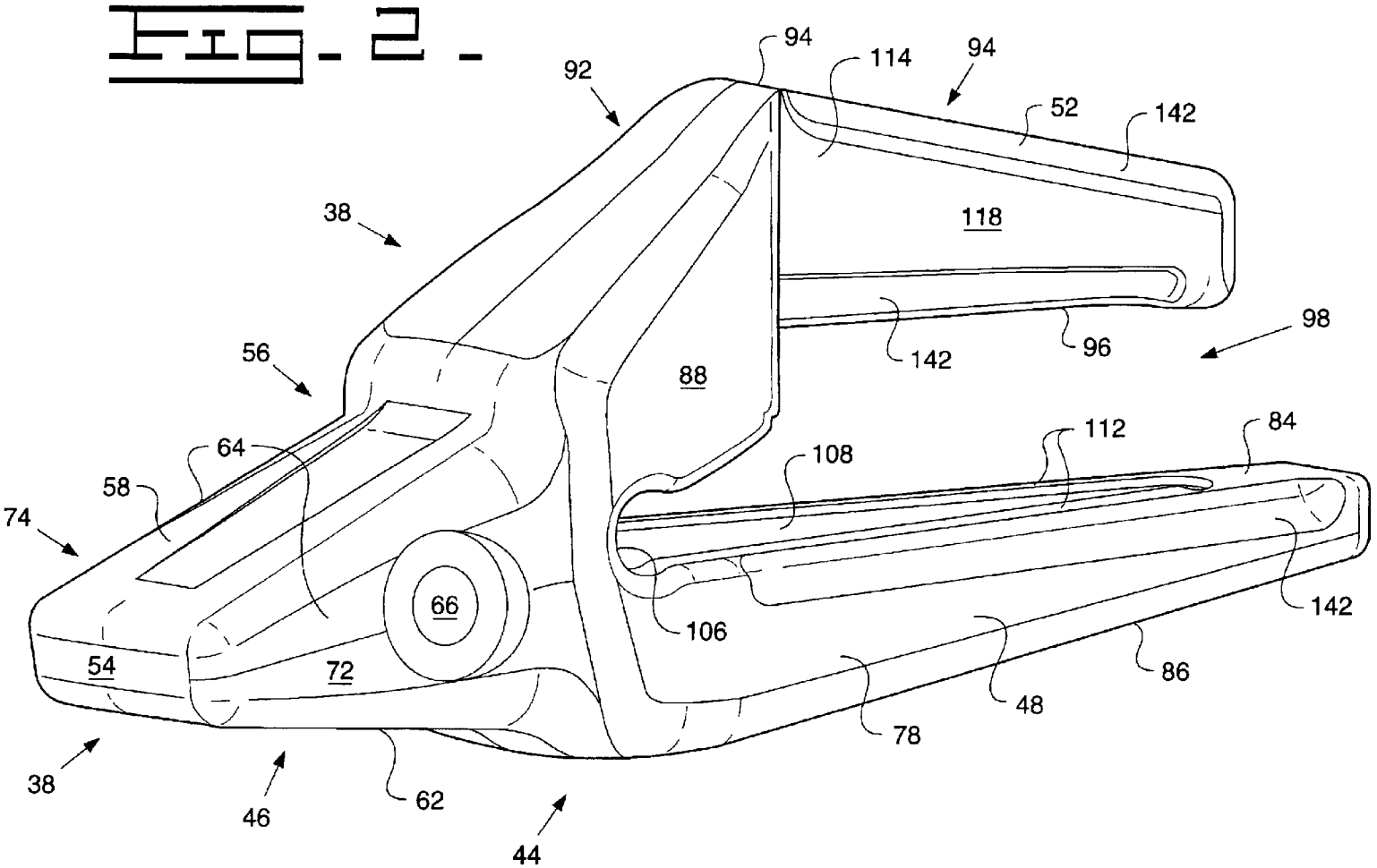
FIG. 2 is a perspective view of a right side corner adapter as viewed from the front of the right side of corner adapter.

Referring now to FIG. 2, the right corner adapter 38 is illustrated. For the remainder of the description, a generic term "corner adapter" 44 will be used with the understanding that the left and right corner adapters 38,42 are substantially mirrored images of one and other. Each adapter 34 includes a nose portion 46, a bottom strap 48 and a top strap 52.

The nose portion 46 is a substantially pointed member configured to extend outward from the base edge 32. The nose portion 46 includes a front end surface 54, a rear end portion 56, a top surface 58, a bottom surface 62 and a pair of side walls 64. The top and bottom surfaces 58,62 converge toward one and other as they approach the front end surface 54 from the rear end portion 56. As illustrated, a bore 66 extends from the first wall 72 of the pair of side walls 64 to the second wall 72 of the pair of side walls 64. The bore 66 is configured to receive a retainer (not shown), for affixing a ground engaging tooth having a mating bore to the adapter 34.

The bottom strap 48 is connected to, and extends in a rearward direction from the rear portion 56 of the nose portion 46, nearest the bottom surface 62. The bottom strap 48 includes a first side surface 78, a second side surface (not shown) opposite the first side surface 78, a top surface 84 and a bottom surface 82.

The top strap 52 is connected to, and extends upward and rearward from the rear portion 56 of the nose portion 46 nearest its top surface 58. The top strap 52 includes a first side surface 88, a second side surface 92, a top surface 94 and a bottom surface 96. A gap 98 is defined between the bottom surface 96 of the top strap 52 and top surface 84 of the bottom strap 48. The gap 98 allows the top strap 52 to be positioned over a top surface 102 of the base edge 32 and the bottom strap 48 to be positioned under a bottom surface 104 of the base edge 32. A radius 106 is defined at an intersection of the bottom surface 96 of the top strap 52 and top surface 84 of the bottom strap 48 near the nose portion 46. A plurality of undercuts 142, are disposed on the top and bottom straps 48, 52. The undercuts 142 provide a surface for depositing a weld bead for attaching the adapter 34 to the bucket 10.

Figure 3:
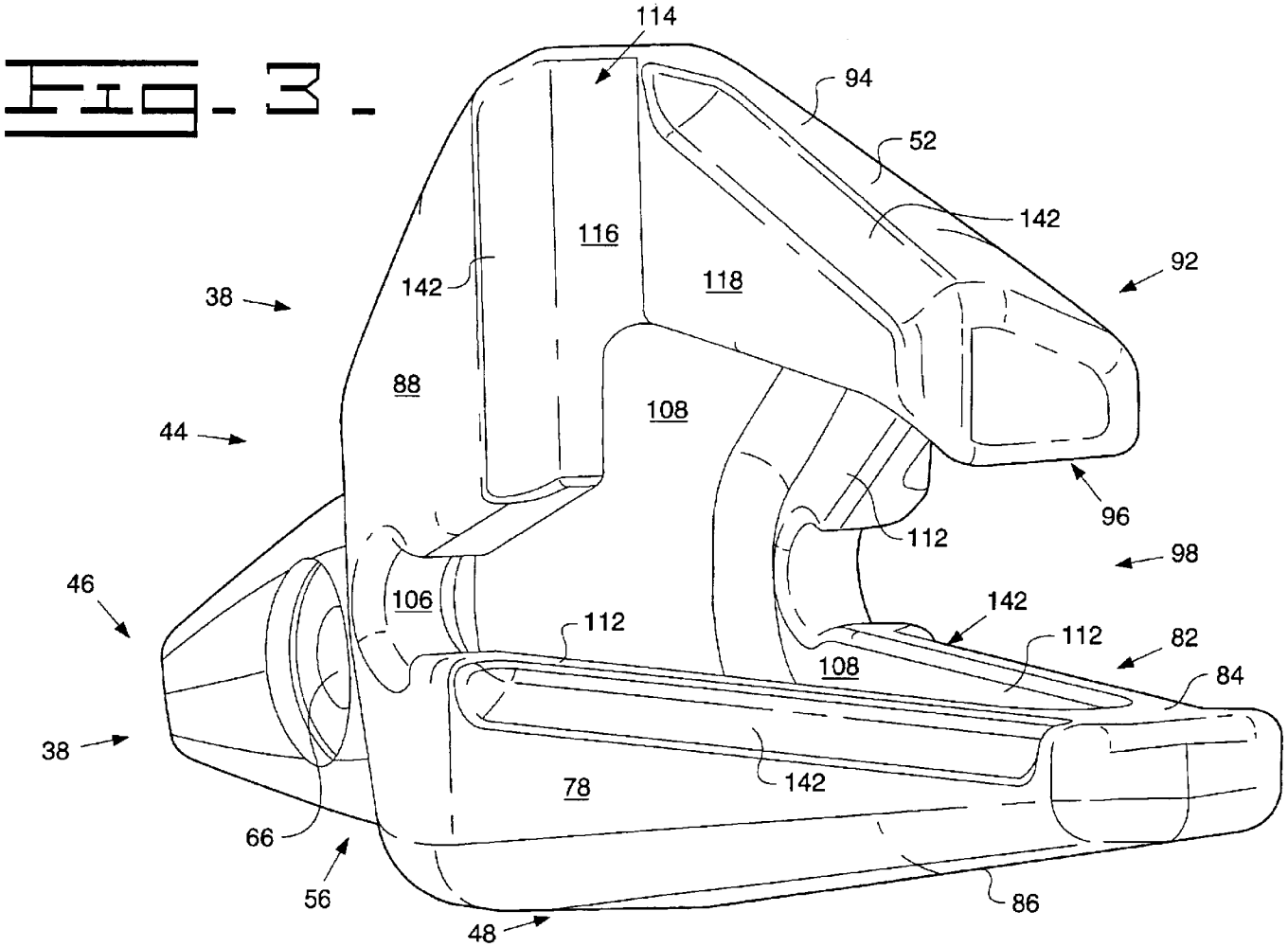
FIG. 3 is a perspective view of a right side corner adapter as viewed from the rear of the right side of the corner adapter.

Referring now to FIG. 3, the adapter defines a cavity 108 that extends along the top surface 84 of the bottom strap 48, upward along the rear portion 56 of the nose portion 46 and rearward along the bottom surface 96 of the top strap 52. The cavity 108 acts to define stiffeners 112 that in turn provide strength to the top and bottom strap 48,52 during use of the bucket 10. Additionally the cavity 108 reduces overall weight of the adapters 34 that in turn increases payload of the bucket 10.

A cutout portion 114 is also defined in the top strap 52 of the corner adapter 44. The cutout portion 114 includes a rearward facing surface 116 and a secondary side wall 118 that is offset from the first side surface 88 of the top strap 52. The cutout portion 114 allows the adapter 34 to be positioned with the secondary side wall 118 against the right side wall 16 of the bucket 10 and the rearward facing surface 116 against the leading edge 122 of right side wall 18 of the bucket 10.

Figure 4:
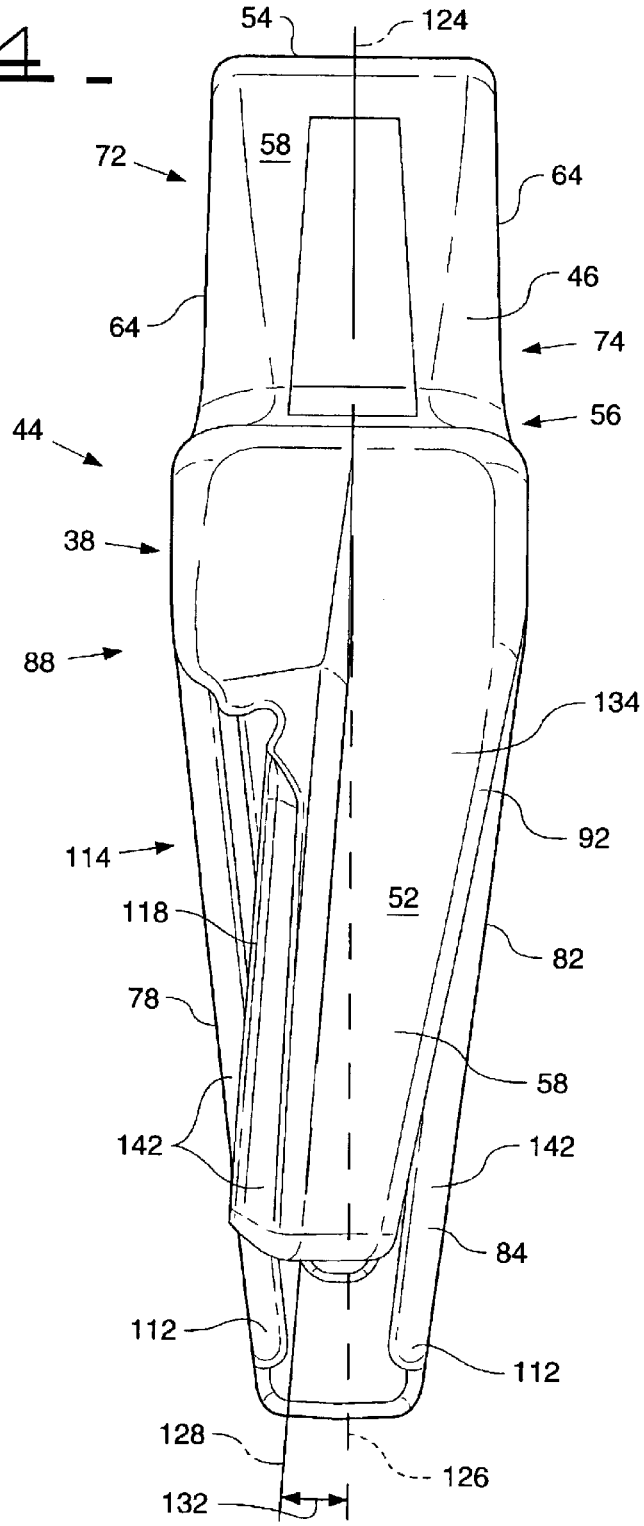
FIG. 4 is a top view of a right side corner adapter.

Referring now to FIG. 4, a first longitudinal centerline 124 is defined on the nose portion 46 substantially midway between the pair of side walls 64. A second longitudinal centerline 126 is defined on the bottom strap 48 substantially midway between first side surface 78 and second side surface 82. The second longitudinal centerline 126 is substantially aligned with the first longitudinal centerline 124. A third longitudinal centerline 128 is defined on the top strap 52 between the secondary side surface 88 and the second side surface 92. An angle 132 is defined between the first longitudinal centerline 124 and the third longitudinal centerline 128.

The combination of the angle 132 and the cutout portion 114 on the top strap 52 permits attachment of the corner adapter 44 with the cutout portion 114 in alignment and abutting the side wall 15 of the bucket 10. The top strap also defines a gusset 134 that acts to strengthen the bucket 10 at the intersection of the side wall 15 and base edge 32. The gusset 134 may have a straight or curved surface.

INDUSTRIAL APPLICABILITY

The corner adapters 44 of the present invention reduce damage to the bucket 10 side wall 15 when worn adapters 34 are replaced. Removal of the corner adapter 44 of the present invention requires removing a weld along the inside of the side wall 15 and around the bottom strap 48. Whereas removal of a prior corner adapter 44 requires removing a weld on the inside and outside of the side wall 15 and around the bottom strap 48. Because less heat is required to remove the weld, there is less opportunity for damage to the side wall 15. Additionally, the gusset on the top strap 52 acts to strengthen the bucket 10 at the intersection of the side wall 15 and base edge 32.

Manufacturing cost associated with the present invention may be reduced by having a single pattern that includes the nose portion 46 and bottom strap 48. Interchangeable patterns for the top strap 52 can be mated with the single pattern to produce castings and reduce manufacturing cost. The top strap 52 patterns include a right pattern, a left pattern and a center pattern.

An additional benefit with the present invention is that as the bucket 10 is used to dig, downward forces on the tooth and corner adapter 44 are better distributed from the top strap 52 to each of the base edge 32 and side wall 15.

What is claimed is:

1. A corner adapter for use with an implement bucket, the implement bucket having a vertical centerline, said corner adapter comprising:

a nose portion having a front end portion, a rear end portion, a top surface, a bottom surface, a pair of side walls, and a first longitudinal centerline being defined between said side walls, said nose portion being adapted to receive a ground engaging tooth;

a bottom strap extending from said rear end portion of said nose portion, said bottom strap having a top surface, a bottom surface and a pair of side surfaces, extending between said top and bottom surfaces, and a second longitudinal centerline being defined substantially midway between said pair of side surfaces; and a top strap extending from said rear portion of said nose portion, said top strap having a top surface, a bottom surface, a first side surface and a second side surface extending between said top and bottom surfaces, and a third longitudinal centerline being defined between said first side surface and said second side surface, wherein an angle is defined between said first longitudinal centerline and said third longitudinal centerline, said angle being greater than zero degrees, such that the nose portion extends away from the vertical centerline of the implement bucket.

2. The corner adapter of claim 1, wherein said angle is in the range of 3 to 6 degrees.

3. The corner adapter of claim 1, wherein said angle is in the range of 2 to 9 degrees.

4. The corner adapter of claim 1, wherein a cutout portion is defined on said first side surface of said top strap, said cutout portion is configured to engage an inner surface of a side wall of said implement bucket.

5. The corner adapter of claim 4, wherein said cutout portion defines a rearward facing surface, said rearward facing surface in said corner adapter being configured to abut a leading edge of the side wall of said bucket.

6. The corner adapter of claim 4, including an undercut defined on said first side surface, and a top edge being configured to receive a weld for attaching said corner adapter to said side wall.

7. The corner adapter of claim 4, including a gusset portion defined between said first side wall and said second side wall of said top strap.

8. The corner adapter of claim 7, wherein said gusset portion defines a substantially flat surface.

9. The corner adapter of claim 7, wherein said gusset portion defines a concave surface.

10. A corner adapter for use with an implement bucket, the implement bucket having a vertical centerline, said corner adapter comprising:

a nose portion having a pair of side walls and a first longitudinal centerline being defined between said side walls;

a bottom strap extending from said nose portion at a first angle, relative to said first centerline; and a top strap extending from said rear portion of said nose portion at a second angle, relative to said first centerline, wherein said second angle is greater than zero degrees, such that the nose portion extends away from the vertical centerline of the implement bucket.

11. The corner adapter of claim 10, wherein said second angle is between 3 and 6 degrees.

12. The corner adapter of claim 10, wherein said first angle is zero degrees.

13. The corner adapter of claim 10, including a cutout portion being defined in said top strap.

* * * * *